US006712679B2

(12) United States Patent
Taylor et al.

(10) Patent No.: US 6,712,679 B2
(45) Date of Patent: Mar. 30, 2004

(54) PLATEN ASSEMBLY HAVING A TOPOGRAPHICALLY ALTERED PLATEN SURFACE

(75) Inventors: Travis R. Taylor, Fremont, CA (US); Cangshan Xu, Fremont, CA (US); Kevin T. Crofton, San Jose, CA (US); Eugene Yuexing Zhao, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 256 days.

(21) Appl. No.: 09/925,254

(22) Filed: Aug. 8, 2001

(65) Prior Publication Data

US 2003/0032379 A1 Feb. 13, 2003

(51) Int. Cl.[7] ..... B24B 1/00

(52) U.S. Cl. ..... 451/303; 451/307; 451/285; 451/288

(58) Field of Search ..... 451/47, 285, 287, 451/288, 307, 303

(56) References Cited

U.S. PATENT DOCUMENTS 5,558,568 A 9/1996 Talieh et al.
5,593,344 A 1/1997 Weldon et al.
5,692,947 A 12/1997 Talieh et al.
5,722,877 A 3/1998 Meyer et al.
5,800,248 A 9/1998 Pant et al.
5,916,012 A 6/1999 Pant et al.
6,000,997 A 12/1999 Kao et al.
6,186,865 B1 * 2/2001 Thornton et al. ..... 451/8
6,368,197 B2 * 4/2002 Elledge ..... 451/296
6,558,234 B2 * 5/2003 Walker et al. ..... 451/41

FOREIGN PATENT DOCUMENTS

EP 0 914 906 A2 5/1999

OTHER PUBLICATIONS

U.S. patent application Ser. No. 09/747,828, "Platen Design for Improving Edge Performance in CMP Applications," Publication No. US 2002/0081947; Inventors: Owczarz et al.; Published: Jun. 27, 2002; Filed: Dec. 21, 2000.
Copy of co–pending Application U.S. Ser. No. 08/968,333, filed Nov. 12, 1997, 77 pages.

* cited by examiner

*Primary Examiner*—Eileen P. Morgan
(74) *Attorney, Agent, or Firm*—Brinks Hofer Gilson & Lione

(57) ABSTRACT

An apparatus for improving performance of a wafer polishing apparatus is described. The apparatus includes a platen in a support assembly having a plurality of fluid channels and at least one region of altered topography positioned on a portion of the platen surface.

40 Claims, 10 Drawing Sheets

PLATEN ASSEMBLY HAVING A TOPOGRAPHICALLY ALTERED PLATEN SURFACE

FIELD OF THE INVENTION

This application relates to chemical mechanical planarization of semiconductor wafers. More particularly, this application relates to a modified platen assembly for providing improved wafer removal profile performance in a linear or rotary polishing system.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuits on wafers are commonly constructed in layers, where a portion of a circuit is created on a first layer and conductive vias connect it to a portion of the circuit on the next layer, each layer can add or create nonuniformity on the wafer that must be smoothed out before generating the next layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. The polishing pad is typically disk or a belt. In some systems, a polishing fluid, such as a chemical polishing agent or slurry containing microabrasives, is applied to the polishing pad to polish the wafer. The wafer holder then presses the wafer against the rotating polishing pad and is rotated to polish and planarize the wafer. In other CMP systems, a fixed-abrasive polishing pad is used to polish the wafer. In fixed-abrasive applications, the wafer holder presses the wafer against the rotating fixed-abrasive polishing pad, deionized water (or some other non-abrasive substance) is applied, and the pad is moved to polish and planarize the wafer.

In linear wafer polishers, a support assembly is often positioned under the linear belt to provide additional support and polishing control to the polishing process taking place on the opposite side of the linear belt. Examples of linear belt supports are shown in U.S. Pat. No. 5,593,344 where one or more fluid bearings are used to support the belt. One objective of the fluid bearings is to help control the wafer removal profile of the linear polisher by adjusting the fluid pressure applied to various zones underneath the belt. Despite the wafer removal profile control that can be achieved with the fluid bearings, some wafer removal variations may remain that require additional compensation. Accordingly, there is a need for an improved mechanism for supporting a linear belt or a rotary pad.

BRIEF SUMMARY

In order to address the need for improved wafer removal profile, a platen for use in a platen assembly for supporting a polishing member, such as a linear belt on a linear polishing apparatus, or a rotary pad on a rotary polishing apparatus, is described below. According to one aspect of the invention, a platen assembly for supporting a polishing member on a polishing apparatus is disclosed that has a platen comprising a substantially planar surface with a leading edge and a trailing edge, where the trailing edge is positioned at an opposite end of the substantially planar surface from the leading edge. A plurality of fluid channels is disposed between the leading and trailing edges of the platen, each of the fluid channels defines a respective opening in the substantially planar surface. At least one region of altered topography is positioned on the platen, where each of the at least one region of altered topography includes one of a region of raised of raised topography and a region of lowered topography relative to the substantially planar surface.

According to another aspect of the invention, the platen assembly includes the platen having a segmented platen ring positioned around a portion of the planar surface. Each segment may be positioned to be a raised or lowered region of topography.

According to another aspect of the invention, a linear belt support assembly for supporting a linear belt, wherein a wafer having a diameter is pressed against one side of the linear belt, includes a platen. The platen includes a substantially planar surface positioned underneath the linear belt opposite the wafer. The substantially planar surface is positioned in the linear belt support assembly and has a diameter that is greater than the diameter of the wafer. The platen further includes a leading edge and a trailing edge, where the trailing edge is positioned at an opposite end of the substantially planar surface from the leading edge. Also a plurality of fluid channels are disposed between the leading and trailing edges of the platen, where each of the fluid channels is a respective opening defined by the substantially planar surface. At least one region of raised topography is positioned on the platen closer to the trailing edge than to the leading edge.

DETAILED DESCRIPTION OF THE PRESENTLY PREFERRED EMBODIMENTS

Figure 1:
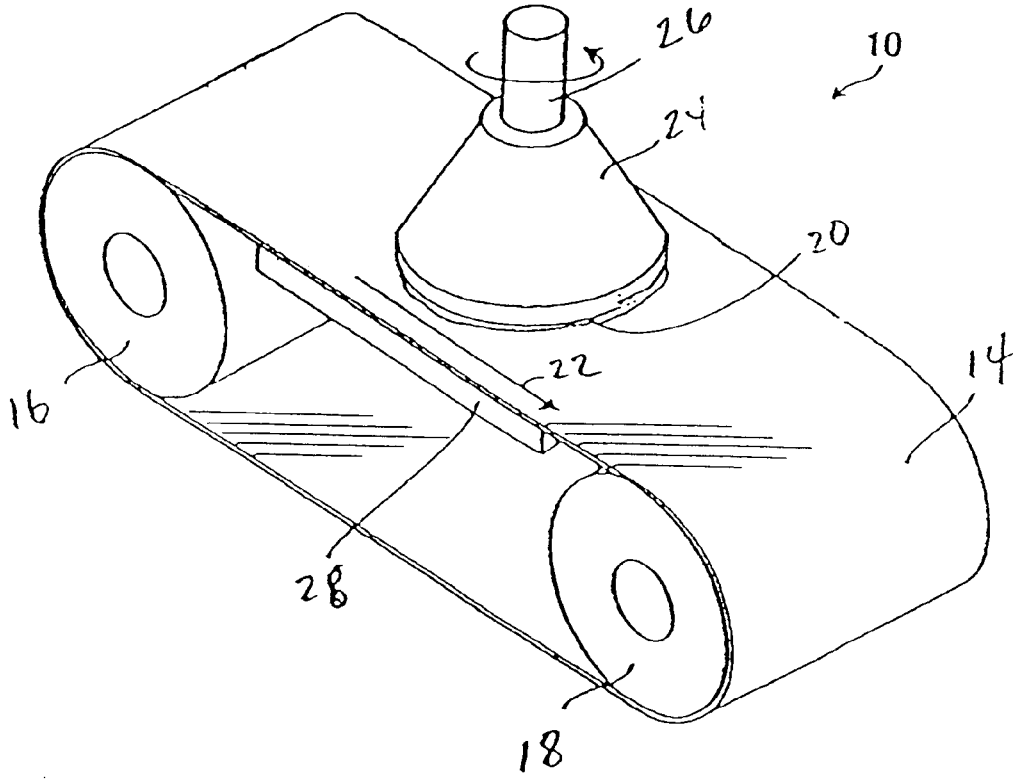
FIG. 1 is a perspective view a linear wafer polisher suitable for use with a platen assembly according to a preferred embodiment.

In order to address the drawbacks of the prior art described above, an apparatus for supporting a linear polishing belt or a rotary polishing pad is described herein that is intended to improve the removal rate profile in a CMP process. Referring to FIG. 1, a linear polisher 10 is shown that is suitable for use with a preferred embodiment of a linear belt support. The linear polisher 10 includes a belt assembly 14 having a polishing pad. The belt assembly 14 may consist of an integrally molded belt and pad combination or a belt having polishing pad and belt components attached in any one of a number of ways known in the art. Examples of suitable belts include the stainless steel belt and polishing pad assemblies sold by Lam Research Corporation and Kevlar belts available from Madison CMP of Salem, N.H. The pad material may be a non-abrasive material configured to transport a chemical and/or abrasive slurry, or a fixed-abrasive pad having abrasive particles fixed in a matrix material. The linear polisher 10 moves the belt assembly 14 linearly around rollers 16, 18 by actively driving one or both of the rollers 16, 18 with a driving mechanism such as a motor. In this manner, the polishing pad on the belt 14 moves past the surface of the wafer 20 in a linear fashion. A direction of movement of the belt assembly 14 is indicated by arrow 22.

A wafer carrier 24, driven by a spindle 26, holds the wafer 20 against the polishing pad on the belt 14. A spindle drive mechanism (not shown) applies rotational and axial force to the spindle 26 so that the wafer 20 is rotated and pressed against the polishing pad on the belt assembly 14. A platen assembly 28 positioned underneath the belt assembly 14 and opposite the wafer carrier 24 supports the belt assembly with a fluid bearing to provide a very low friction surface that can be adjusted to compensate for polishing variations. Suitable linear polishers include the linear polishers in the TERES CMP System available from Lam Research Corporation of Fremont, Calif. One example of a linear polisher that may be used with the present invention is disclosed in U.S. application Ser. No. 08/968,333 filed Nov. 12, 1997 and entitled "Method and Apparatus for Polishing Semiconductor Wafers", the entire disclosure of which is incorporated herein by reference.

Figure 2:
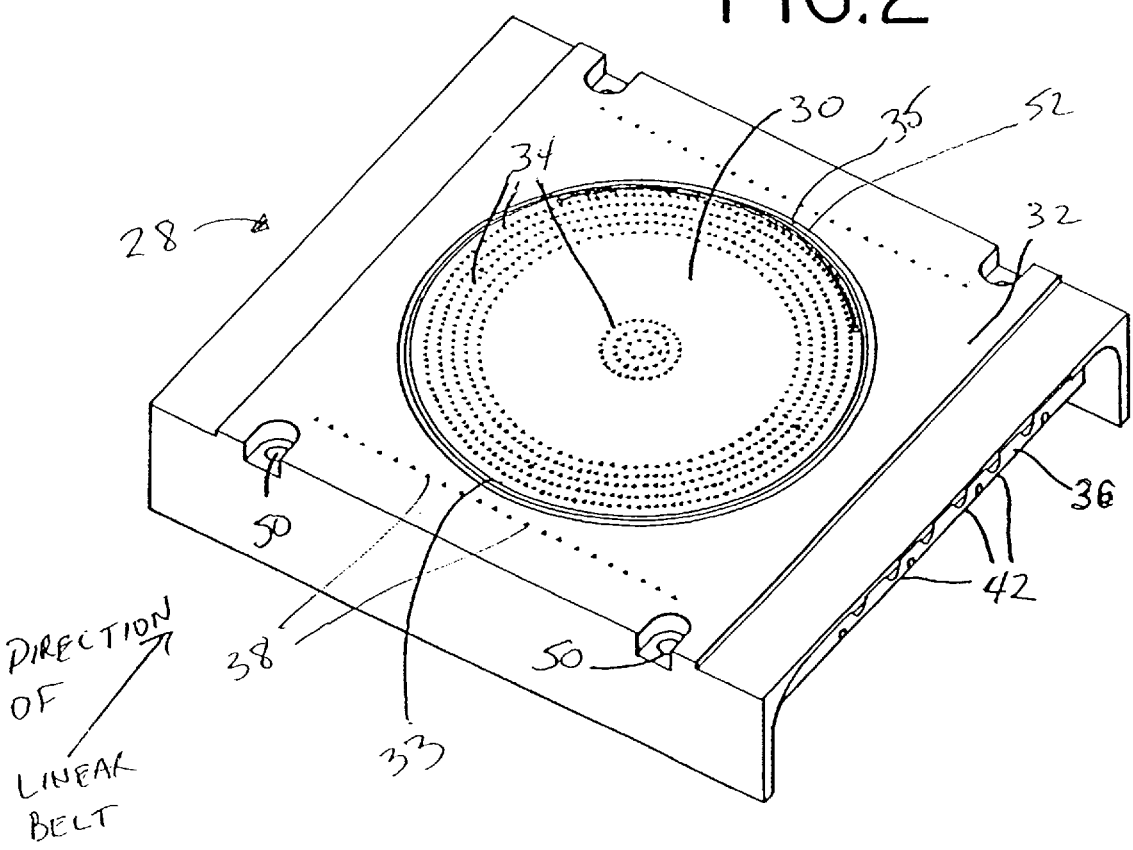
FIG. 2 illustrates a platen assembly according to one preferred embodiment.
Figure 3:
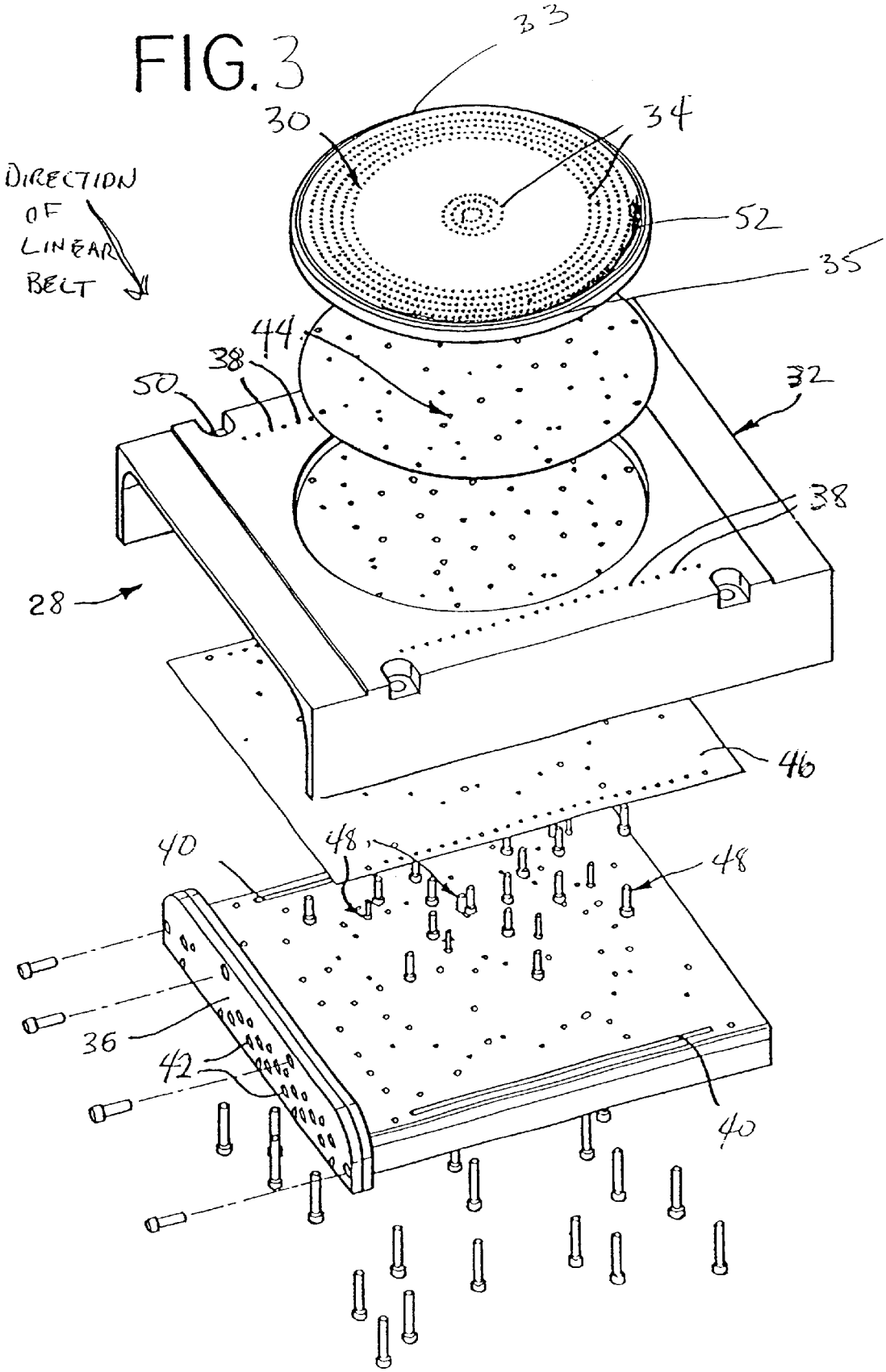
FIG. 3 is an exploded view of the platen assembly of FIG. 2.

Referring to FIGS. 2–3, the platen assembly 28 controls the gap between the back of the belt and the platen 30. The platen assembly 28 is preferably removably attachable to a frame of the polisher 10 between the rollers 16,18. The platen assembly 28 comprises a replaceable disk platen 30 mounted on a disk platen holder 32. The platen 30 preferably has a substantially planar surface larger than the surface of a wafer to be polished, and may be constructed of a metal, such as brass, or other rigid material. A plurality of fluid channels 34 is disposed on the platen 30, where each of the fluid channels 34 may be an opening in the substantially planar surface of the platen. When the platen 30 is mounted in the platen holder 32, the platen 30 has a leading edge 33 that is arranged to receive the belt as the belt initially passes over the platen assembly 28, and a trailing edge 35 that is the last portion of the platen to support the belt as it passes over the platen assembly.

A manifold assembly 36 underneath the disk platen holder 32 is designed to distribute fluid to the disk platen in precise amounts. In one embodiment, the disk platen holder 32 may include a row of nozzles 38 arranged along at least one of the edges perpendicular to the direction of motion of the belt 178. Fluid is directed to nozzles 38 from a manifold 40 on the manifold assembly 36. The nozzles 38 may be used to reduce the friction of the belt against the edges of the disk platen holder by providing a small amount of buffer between the disk platen holder and the belt as the belt initially passes over the platen assembly 28. Preferably, the fluid utilized is air and the manifold assembly 36 has a plurality of pneumatic quick disconnect ports 42 that permit easy engagement and disengagement of air supplies to the platen assembly 28. A platen disk gasket 44 provides a seal between the platen 30 and platen holder 32. Similarly, a platen holder gasket 46 supplies a seal between the manifold assembly 36 and the platen holder 32. A plurality of fasteners 48 hold the platen assembly 28 together and four connector holes 50 cooperate with fasteners (not shown) for installing or removing the assemble platen assembly 28 from the polisher 38.

In a preferred embodiment, the platen 30 may have one or more regions of raised and/or lowered topography. Referring to FIGS. 2–3, although any change in the overall topography of the platen surface is contemplated, whether located on the trailing, leading, front and rear quadrants, a region of raised topography 52 is preferably positioned closer to the trailing edge 35 of the platen assembly than to the leading edge 33. As shown in FIGS. 2–3, the region of raised topography is in the form of an arc positioned outside to the last row of fluid passages 34 on the trailing edge 35. The region of raised topography may be a separate material adhered to the platen surface, integrally formed with the surface of the platen 30, or movably positioned on the platen. The arc length of the region of raised topography is preferably less than 180°, and more preferably 30°, and the height may be in the range 0.000 to 0.250 inches with respect to the platen surface. In an alternative embodiment, regions of lowered topography may be substituted for, or combined with, the region of raised topography on a platen. The regions of lowered topography are preferably integrally molded into, or carved from the original platen surface. The lowered regions may have a depth in the range of −0.250 to 0.000 inches with respect to the platen surface. Also, the regions of lowered topography can be mechanically created and eliminated using movable posts that are mechanically controllable to raise or lower from the planar surface of the platen. The movable posts may be operated using any of a manner of known actuating mechanisms (e.g. electrical, hydraulic, pneumatic, etc.).

Figure 4:
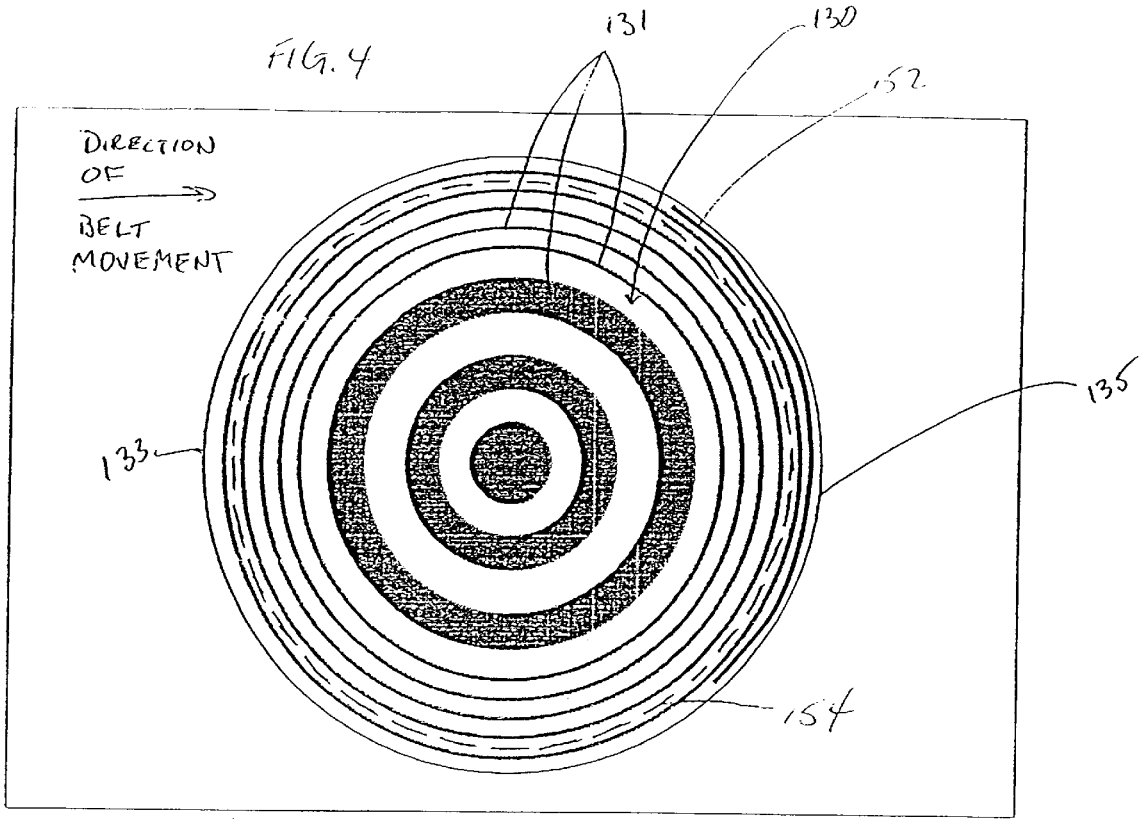
FIG. 4 is a plan view of a platen assembly according to a first alternative embodiment.

In FIG. 4, a particular platen arrangement incorporating a region of raised topography 152 is illustrated. The platen 130 includes eight zones 131 arranged as concentric rings about the center of the platen between the leading and trailing edges 133, 135. The different zone 131 widths illustrated in FIG. 4 represent different densities of fluid channels, where the wider line widths represent a higher density of fluid channels than the narrower zone widths. A dashed line representation of a wafer 154 is shown in FIG. 4 to illustrate the position of the wafer relative to the zones 131 of fluid channels on the platen 130 when the wafer is pressed against the belt opposite the platen. Preferably, the platen is sized, and the wafer aligned, such that one or more concentric rings of fluid channels lay outside of the outermost edge of the wafer.

Additionally, as shown in FIG. 4, the region of raised topography 152 is preferably positioned outside the wafer's edge in one embodiment. In this embodiment, a 300 millimeter wafer size is assumed and the region of raised topography 152 may be formed of a material such as a strip of Rodel IC1000 pad material, or Rodel carrier film, having a height in the range of approximately 0.030 inches to 0.040 inches and a width of approximately 3 millimeters. These Rodel materials are available from Rodel Corporation in Phoenix, Ariz. The strip of material is preferably centered so that it is symmetric about the diameter of the platen extending from the leading edge to the trailing edge and may be of varied length, having an arc length of less than 180°, depending on the application.

Figure 5:
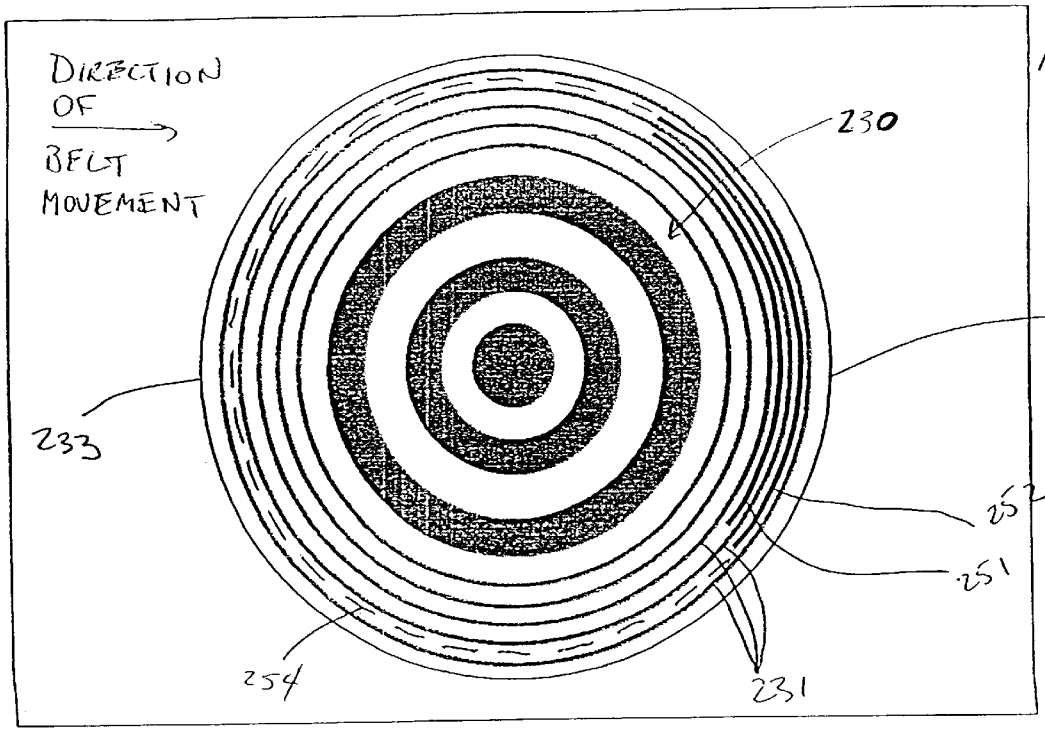
FIG. 5 is a plan view of a platen assembly according to a second alternative embodiment.
Figure 6:
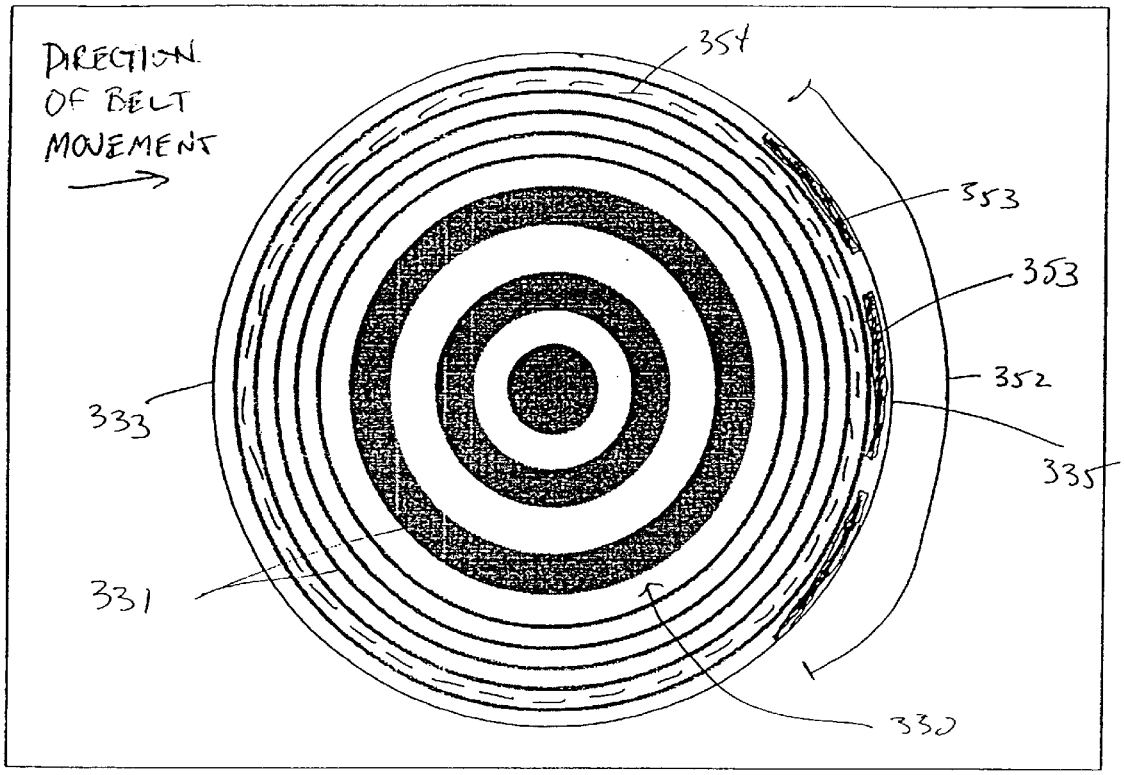
FIG. 6 is a plan view of a platen assembly according to a third alternative embodiment.
Figure 7A:
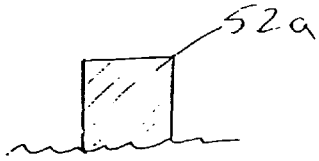
FIG. 7A is a cross-sectional view of a region of raised topography suitable for use on the platen assemblies of FIGS. 2–6.
Figure 7B:
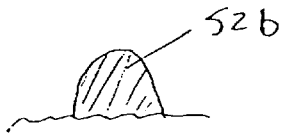
FIG. 7B is a first alternative embodiment of the cross-sectional view of FIG. 7A.
Figure 7C:
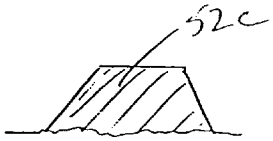
FIG. 7C is a second alternative embodiment of the cross-sectional view of FIG. 7A.
Figure 7D:
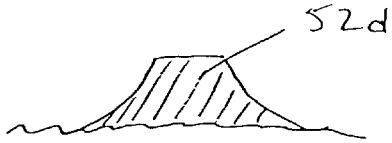
FIG. 7D is a third alternative embodiment of the cross-sectional view of FIG. 7A.

Other embodiments illustrating regions of raised topography are shown in FIGS. 5 and 6. Although various arrangements of zones for controlling the pressure against the linear belt may be used to position the fluid channels, zones having concentric ring configurations of fluid channels are used below in order to simplify the following discussion of the various embodiments of regions of raised topography on the platen. Other discrete patterns of fluid channels, including fluid channels aligned in a line, or in small groups that are of one or many different geometric shapes, may be used. Also as described above, regions of raised topography, lowered topography, or a mixture of the two may be positioned in any portion of the platen surface. FIG. 5 shows a platen 230 with first and second regions of raised topography 251, 252. As with the embodiments of FIGS. 1–4, the regions of raised topography are positioned closer to the trailing edge 235 than to the leading edge 233 of the platen 230. In FIG. 5, however, two regions of raised topography 251, 252 are shown adjacent consecutive rows of fluid channels 231. Also, the regions of raised topography are positioned within the outer diameter of the wafer 254 represented by dashed lines. In alternative embodiments, the regions of raised topography 251, 252 may be more spaced apart radially so that more than one row of fluid channels 231 separates the regions of raised topography.

The embodiment of FIG. 6 shows a region of raised topography 353 composed of segments 353 symmetrically spaced about the diameter of the platen 330 that extends from the leading edge 333 to the trailing edge 335. Although shown positioned outside the diameter of the wafer 354, the region of raised topography may be located under the belt at a point that is also under the wafer and there may be regions of raised topography at more than one radial position, as shown in FIG. 5. Each of the segments 353 making up the region of raised topography 352 may be juxtaposed with the next adjacent segment or they all may be spaced apart from one another. Furthermore, the segments may be constructed of one or a combination of materials.

Figure 8:
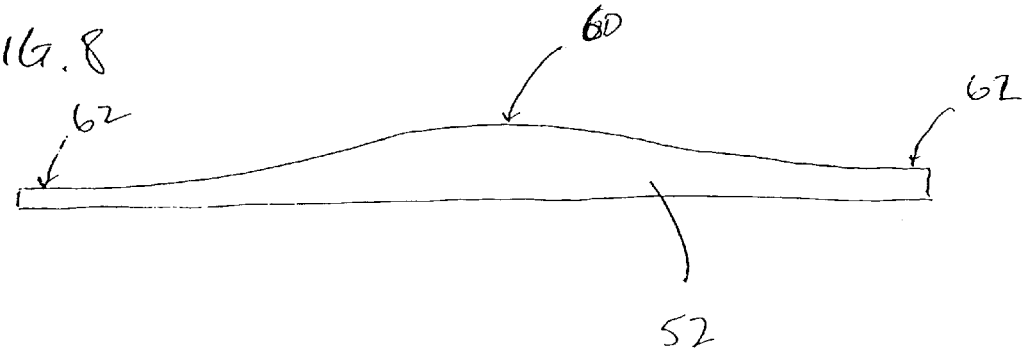
FIG. 8 illustrates a side view of a region of raised topography suitable for use on the platen assemblies of FIGS. 2–6.

Each region of raised topography, whether attached to, or part of, the platen, may have one of several cross-sectional shapes to aid in the overall performance of adjusting the wafer removal rate profile. As shown in FIGS. 7A–7D, a square cross-sectional profile 52*a*, dome-like cross-sectional profile 52*b*, ramp cross-sectional profile 52*c*, slope cross-sectional profile 52*d*, or combination of these or other cross-sectional profiles may be used for each region of raised topography. While the overall height of the region of raised topography is preferably even along its length, in other preferred embodiments the region of raised topography 52 may include a raised center portion 60 and tapered end portions 62 as illustrated in the side view of FIG. 8.

Figure 9:
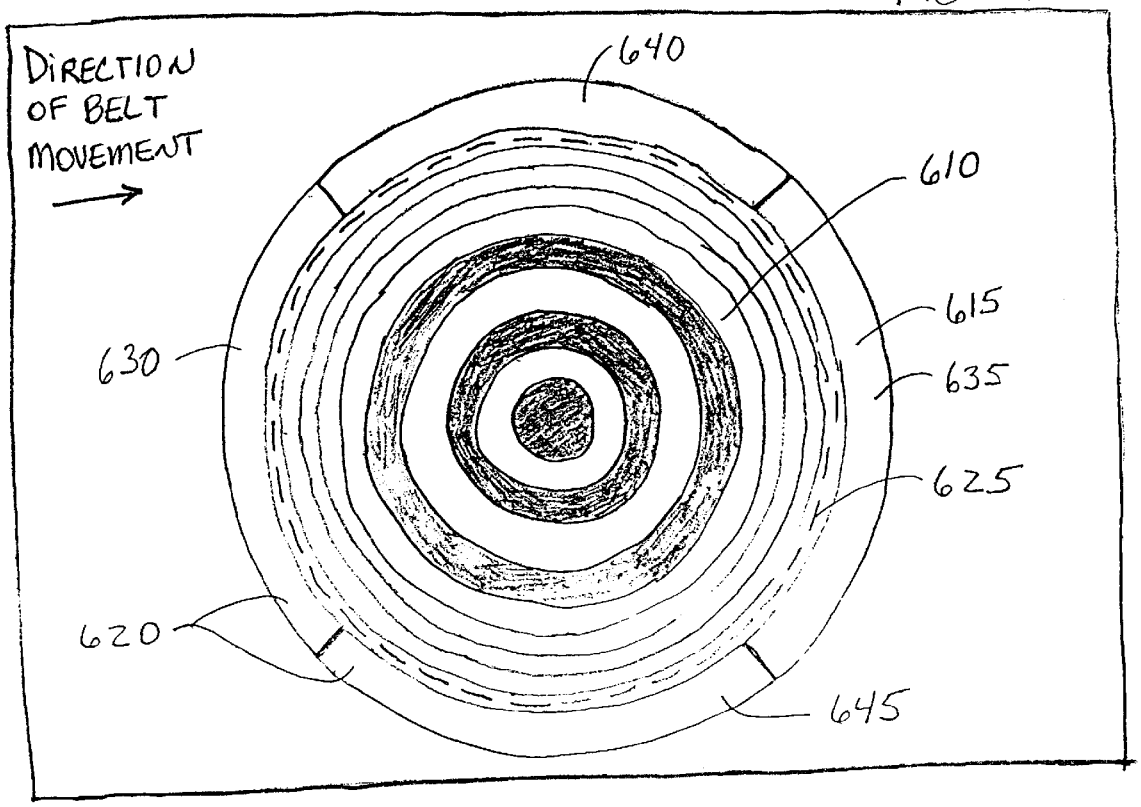
FIG. 9 is a plan view of a platen assembly according to a fourth alternative embodiment.

FIG. 9 illustrates another embodiment of a platen 610 that is a further variance of the embodiment shown in FIG. 6. This embodiment shows a platen ring 615 composed of segments 620 placed around the platen 610 and positioned outside the diameter of a wafer 625 (represented by dashed lines). The platen ring 615 may be constructed of one or a combination of materials, and is sectioned into at least four segments 620. For embodiments that have four segments, there is a leading edge segment 630, a trailing edge segment 635, a rear segment 640, and a front segment 645.

Each segment 620 is independently adjustable from the other segments, and may be either raised or lowered relative to the platen surface so that each segment 620 may comprise either a region of raised or lowered topography, depending on processing requirements. In a preferred embodiment, the segments may be positioned at an elevated height of 0.000 to 0.0250 inches or at a lowered height of 0.000 to −0.059 inches relative to the platen surface, although other ranges are also possible, again depending on processing requirements. The positioning of the trailing edge segment 635 and the leading edge segment 630 are dependent on application requirements, but in general will be similar to those described above, i.e., positions of raised topography are positioned closer to the trailing edge 635 than the leading edge 630. Moreover, the segments are smooth, and may have any suitable shape, such as, by way of example, a square or rounded shape, or any of the profiles described above.

The segments may be raised or lowered through a number of techniques. For example, shims may be used to place the segments into raised or lowered positions, or the mechanical posts noted above may be used to position the segments. Additionally, the segments may be individually adjusted through the use of a software-controlled recipe parameter and controller so that the segments are set to predetermined positions at the start of a polishing cycle. The actual movement of the segments into raised or lowered positions may be accomplished through a height adjustment apparatus such as an electrical motor, pneumatic system, or hydraulic system that receives a signal from the controller.

The positioning of the segments may also be accomplished through a feedback signal to the controller so that the positioning of the segments may be automatically adjusted for each wafer that is to be polished. In this embodiment, after a wafer is polished a metrology tool within the linear polisher 10 optically measures the surface layer thickness of the wafer at a plurality of positions on the film surface layer. Measuring the surface layer thickness of the wafer determines the amount of unevenness that has been removed from the wafer surface during the polishing cycle. The measurement taken from the metrology tool is then sent to the controller, which then compares the actual measured surface layer thickness to a target thickness range. Preferably, the target thickness range is ±1–3% of a target thickness. For example, suppose an unpolished wafer has a surface layer thickness of 1 micron, or 10,000 Angstroms, and the target thickness of the surface layer is 4,000 Angstroms. If the acceptable target thickness range is ±1% (depending on application requirements), a properly polished wafer must have a surface layer thickness that varies between 3,960 Angstroms and 4,040 Angstroms along the wafer surface.

Alternatively, the surface layer thickness measurement may be obtained from a factory-level advanced process control system.

After comparing the surface layer thickness to the target thickness range, the controller may send a signal to the motor to reposition the individual segments. The amount of adjustment depends on the actual surface layer thickness measured, and is calculated according to the recipe that has been programmed into the software. Depending on the measurements taken, the controller will then direct a driving mechanism, such as a motor, hydraulic system, or pneumatic system, to raise and/or lower the individual segments as needed and according to the recipe parameters that have been programmed.

Figure 10:
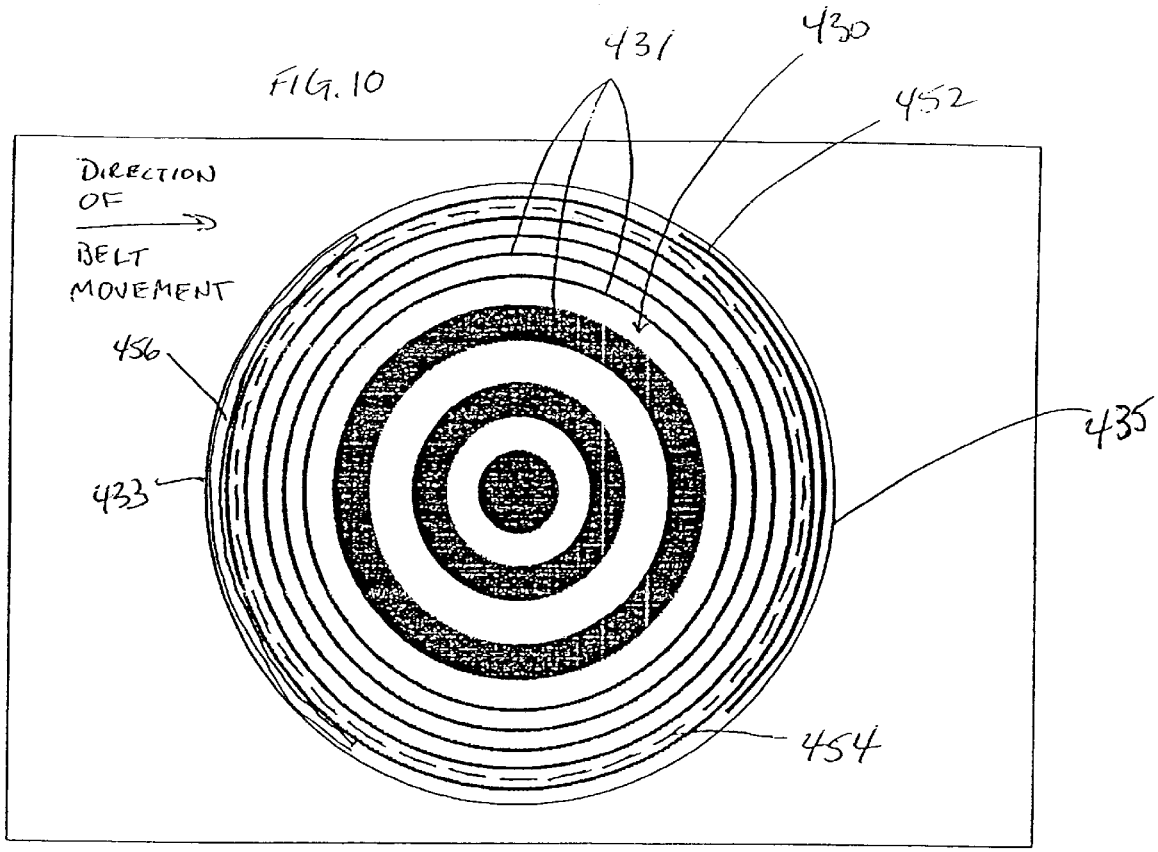
FIG. 10 is a plan view of a platen assembly according to a fifth alternative embodiment.
Figure 11:
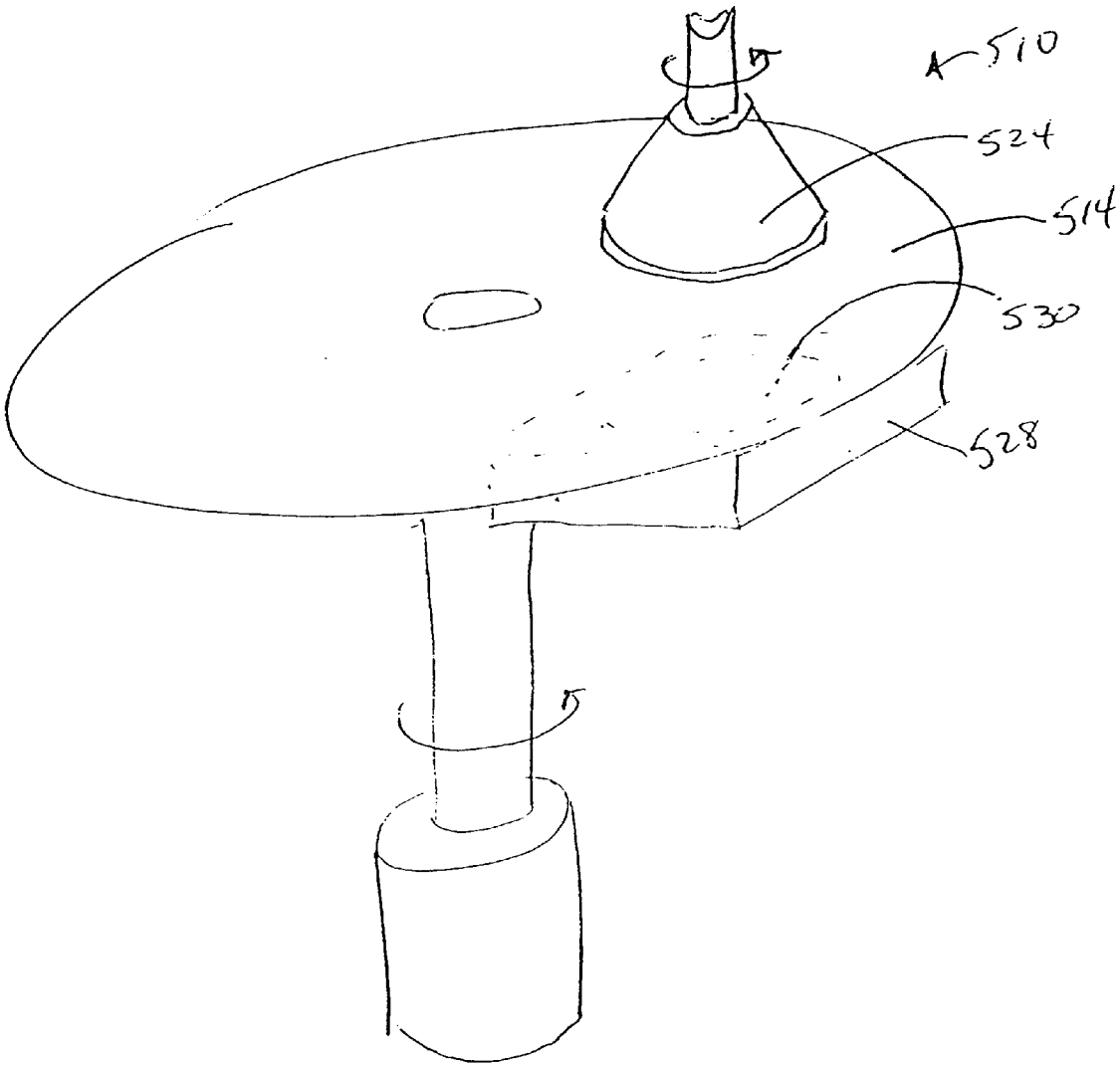
FIG. 11 is a perspective view a rotary wafer polisher suitable for use with a platen assembly according to a preferred embodiment.

FIG. 10 illustrates an embodiment of a platen having regions of altered topography at the leading and trailing edges 433, 435 of the platen 430. The altered topography at the leading edge 433 is preferably a region of lowered topography 456 oriented symmetrically about the leading edge 433 of the platen. The region of lowered topography may include one continuous recessed region or separate recessed segments. The region or regions of lowered topography 456 may be integrally formed in the platen 430 as recessed areas in relation to the substantially planar platen surface. The recesses may be rectilinear-type trenches, rounded trenches or any other shape of recess (e.g. the inverse of the profiles shown in FIGS. 7A and 7D). The altered topography at the trailing edge 435 is preferably a region of raised topography 452 such as discussed with respect to FIGS. 2–8. The regions of altered topography may be positioned outside the outer diameter 454 of the wafer footprint, inside the outer diameter 454 or on both sides. Preferably, the altered topography is positioned between the rows of fluid channels 431. In FIG. 11, as in FIGS. 4–6, the fluid channels are represented by concentric circles of differing thickness. Each concentric circle represents a series of discrete fluid outlets and the thicker circles represent a greater number and/or density of fluid outlets than the thinner circles. In other embodiments, the fluid outlets may be arranged radially and the regions of altered topography (raised or lowered) may be oriented radially on the platen. Improved planarization performance is also contemplated through placing regions of altered topography toward the center or side edges of the platen.

Referring again to FIGS. 1–3, in operation, the platen assembly 28 receives a controlled supply of air, or other fluid, from platen fluid mass flow controllers (not shown) in the CMP system that the polisher 10 is connected with. Other fluid flow control devices may also be used with the presently preferred platen assembly. The controlled fluid flow from the mass flow controllers are received at the manifold assembly 36 and distributed to the plurality of fluid passages 34 in the disk platen 30. The air, or other fluid, emerging from the fluid passages 34 creates a fluid bearing that puts pressure on the underside of the belt in a precise, controlled manner while minimizing friction against the belt as it continuously travels over the air bearing. In another preferred embodiment, the manifold assembly may be omitted and individual hoses or tubes may distribute fluid to the appropriate nozzles or vents in the platen assembly. It has been observed that, in some CMP applications using fluid bearings, the outer region of a wafer may evidence a slower removal profile than the rest of the wafer. The region of raised topography 52, in combination with the air bearing, preferably assists in improving the wafer removal profile at the outer edge of the wafer.

In the embodiment mentioned previously where the region of raised topography is movably positionable on the platen surface, it is contemplated that one or more regions of raised topography having one or more segments may be used. Each region of raised topography may be constructed of the same material as the remainder of the platen or a different material. Each region, or region segment, is preferably slidably positioned within a cooperatively shaped recess in the platen surface. Lifting mechanisms, such as pneumatic or hydraulic devices commonly known in the art, may be connected to the region of raised topography and controllable via a manually adjustable control circuit or automated microprocessor circuit. The lifting mechanism or mechanisms may be controlled by the microprocessor to adjust the height of the region of raised topography above the planar surface of the platen according to predetermined criteria or use feed back on wafer removal rate to provide real-time height adjustment. Utilizing the lifting mechanism, the region of raised topography may be moved to any height from a first position, where the upper surface of the region of raised topography is even with the surface of the plate, to a second position where the upper surface of the region of raised topography is above the substantially planar surface of the platen. Conversely, the lifting mechanism may be fabricated to permit downward movement, or to permit both upward and downward movement, so that regions of lowered topography may be created as well.

An advantage of the altered platen topography described herein is the ability to compensate for polishing head tilt that may occur with gimbaled polishing heads. In linear polishers, such as the linear polisher 10 of FIG. 1, a gimbaled polishing head is often used to hold a semiconductor wafer against the polishing pad. Although gimbaled polishing heads can adjust to achieve a parallel alignment between the polishing head and the belt, the high linear velocity of the belt may cause the polishing head to tilt such that the polishing head digs into the belt at the leading edge and lifts up from the belt at the trailing edge. The leading edge will then experience a high removal rate and the trailing edge will experience a lower removal rate. By raising the topography of the platen in the region of the trailing edge, the belt is effectively lifted up to better contact the trailing edge of the polishing head. Also, the removal rate at the leading edge may be reduced by lowering the topography of the platen in the region of the leading edge. These alterations of the substantially flat platen topography may be used separately or together to adjust removal rate profiles as desired.

In FIG. 11, a rotary polishing module 510 is illustrated that incorporates a fluid platen 530 positioned in a fluid platen assembly 528 positioned beneath the polishing pad opposite the wafer holding head 524. A polishing pad is preferably mounted on, or integral with, a disc-shaped or annular support layer 514 that is flexible enough to benefit from the support of the fluid platen but stiff enough to maintain its shape. One type of support layer suitable for use in a rotary application is stainless steel. Any of a number of known rotary polisher drive mechanisms and control circuitry may be used. As with the linear polisher 10 discussed above, the rotary polishing module 510 can also benefit from the altered topography platen surface to alleviate the polishing head tilt that occurs with gimbaled wafer holding heads. All of the same variations for altered topography discussed in FIGS. 2–10 are applicable to the rotary polishing module configuration of FIG. 11. In the rotary application, the leading edge and trailing edge of the platen may also be defined as set forth above, however the curvature of the rotary pad may dictate that the center of the leading edge be defined at a point on the circumference of the platen that is less than 180° from the center of the trailing edge on the opposite side of the platen.

A topographically altered platen surface has been described having one or more regions of altered topography positioned on the platen, preferably toward the leading or trailing edge of the platen. The altered platen topography disclosed herein may be utilized on platens for linear polishers having any of a variety of linear belt assembly types, including stainless steel belts, Kevlar belts and other belt materials. The altered platen topography may also be applied to rotary polisher applications having flexible polishing member supports. The platens with regions of altered topography may be used for any proportionally sized wafer and any of a number of wafer types including, but not limited to dielectric (e.g., oxide, nitride, low k) and metal (e.g., copper, tungsten, aluminum).

It is intended that the foregoing detailed description be regarded as illustrative, rather than limiting, and that it be understood that the following claims, including all equivalents, are intended to define the scope of this invention.

What is claimed is:

1. In a platen assembly for supporting a polishing member on a polishing apparatus, a platen comprising:

a substantially planar surface having a leading edge, wherein the trailing edge is positioned at an opposite end of the substantially planar surface from the leading edge;

a plurality of fluid channels disposed between the leading and trailing edges of the platen, wherein each of the fluid channels comprises a respective opening defined by the substantially planar surface; and at least one region of altered topography positioned on the platen, wherein the at least one region of altered topography is shaped as a continuous arc having an arc length less than 180°, and each of the at least one region of altered topography comprises one of a region of raised topography and a region of lowered topography relative to the substantially planar surface.

2. The apparatus of claim 1, wherein the polishing member and the polishing apparatus comprise a linear polishing member and a linear polishing apparatus, respectively, and wherein the at least one region of altered topography comprises a region of raised topography positioned closer to the trailing edge than to the leading edge.

3. The apparatus of claim 1, wherein the polishing member and the polishing apparatus comprise a rotary polishing member and a rotary polishing apparatus, respectively, and wherein the at least one region of altered topography comprises a region of raised topography positioned closer to the trailing edge than to the leading edge.

4. The apparatus of claims 2 or 3, wherein the at least one region of altered topography further comprises a region of lowered topography positioned closer to the leading edge than to the trailing edge.

5. The apparatus of claim 1, wherein the plurality of fluid channels are arranged in a plurality of concentric circle patterns on the substantially planar surface.

6. The apparatus of claim 5, wherein the at least one region of altered topography is positioned between two adjacent concentric circle patterns of fluid channels.

7. The apparatus of claim 1, wherein the at least one region of altered topography comprises a unitary part of the substantially planar surface of the platen.

8. The apparatus of claim 1, wherein the substantially planar surface of the platen comprises a first material and the at least one region of altered topography comprises a region of raised topography comprised of a second material that is different than the first material.

9. The apparatus of claim 8, wherein the second material is removably attached to the first material.

10. The apparatus of claim 8, wherein the second material is attached to the first material by an adhesive.

11. The apparatus of claim 1, wherein the region of altered topography comprises a region of raised topography having a height in a range of 0.000 to 0.250 inches.

12. The apparatus of claim 1, wherein the region of altered topography comprises a region of raised topography having a height in a range of 0.030 to 0.040 inches.

13. The apparatus of claim 1, wherein the at least one region of altered topography is adjacent to at least one of the plurality of fluid channels.

14. The apparatus of claim 5, wherein the arc length of the at least one region of altered topography is measured with respect to a center point of the platen.

15. The apparatus of claim 14, wherein the at least one region of altered topography is positioned radially outward of at least one concentric circle of fluid channels.

16. The apparatus of claim 14, wherein the at least one region of altered topography is positioned radially outward beyond the outermost concentric circle of fluid channels.

17. In a linear polishing apparatus having a linear belt support assembly for supporting a linear belt, wherein a wafer having a diameter is pressed against one side of the linear belt, a platen comprising:

a substantially planar surface positioned underneath the linear belt opposite the wafer, the substantially planar surface positioned in the linear belt support assembly and comprising a diameter that is greater than the diameter of the wafer, the platen further comprising a leading edge and a trailing edge, wherein the trailing edge is positioned at an opposite end of the substantially planar surface from the leading edge;

a plurality of fluid channels disposed between the leading and trailing edges of the platen, wherein each of the fluid channels comprises a respective opening defined by the substantially planar surface; and at least one region of raised topography being symmetric about a diameter of the platen extending from the leading edge to the trailing edge and positioned closer to the trailing edge than to the leading edge, wherein the at least one region of raise topography is shaped as a continuous arc having an arc length less than 180°.

18. The apparatus of claim 17, wherein the plurality of fluid channels are arranged in a plurality of concentric circle patterns on the substantially planar surface.

19. The apparatus of claim 17, wherein the at least one region of raised topography is positioned at a location on the platen outside of the diameter of the wafer.

20. The apparatus of claim 17, wherein the at least one region of raised topography comprises a unitary part of the substantially planar surface of the platen.

21. The apparatus of claim 17, wherein the substantially planar surface of the platen comprises a first material and the at least one region of raised topography comprises second material that is different than the first material.

22. The apparatus of claim 17, wherein the at least one region of raised topography is movably positioned in the platen.

23. The apparatus of claim 15, wherein the at least one region of raised topography has a height that varies along its length.

24. The apparatus of claim 17, wherein the at least one region of raised topography comprises a first region of raised topography positioned at a first radial distance from a center of the platen, and a second region of raised topography positioned at a second radial distance from the center of the platen, wherein the first and second radial distances are different.

25. The apparatus of claim 17, wherein the at least one region of raised topography is non-movable, and is in a fixed position on the platen.

26. In a platen assembly for supporting a polishing member on a polishing apparatus, a platen comprising:

a substantially planar surface positioned underneath the polishing member opposite the wafer, the substantially planar surface positioned in the support assembly and comprising a diameter that is greater than the diameter of the wafer, the platen further comprising a leading edge and a trailing edge, wherein the trailing edge is positioned at an opposite end of the substantially planar surface from the leading edge;

a plurality of fluid channels disposed between the leading and trailing edges of the platen, wherein each of the fluid channels comprises a respective opening defined by the substantially planar surface; and a segmented platen ring positioned around a portion of the planar surface, wherein each segment may be positioned to be a raised or lowered region of topography.

27. The apparatus of claim 26, wherein the plurality of fluid channels are arranged in a plurality of concentric circle patterns on the substantially planar surface.

28. The apparatus of claim 26, wherein the segment is a raised region of topography having a height of no more than 0.250 inches.

29. The apparatus of claim 26, wherein the segment is a lowered region of topography having a height of no more than −0.250 inches.

30. The apparatus of claim 26, wherein the platen ring is composed of four segments.

31. The apparatus of claim 26 further comprising mechanical posts, wherein a height of the individual segments may be adjusted through the use of the mechanical posts.

32. The apparatus of claim 26 further comprising a controller, wherein the controller is programmed so that the controller may send a signal to adjust a height of the individual segments.

33. The apparatus of claim 32, wherein the controller sends a signal to an electrical motor.

34. The apparatus of claim 32, wherein the controller sends a signal to a pneumatic height adjustment apparatus to adjust a height of the individual segments.

35. The apparatus of claim 32, wherein the controller sends a signal to a hydraulic height adjustment apparatus to adjust a height of the individual segments.

36. The apparatus of claim 32 further comprising a metrology tool to measure a surface layer thickness of a polished wafer, wherein a surface layer thickness measurement is sent to the controller so that the controller may send a signal to adjust a height of the individual segments.

37. The apparatus of claim 32, wherein a surface layer thickness measurement of a polished wafer is obtained from a factory-level advanced process control system, and wherein the surface layer thickness measurement is sent to the controller so that the controller may send a signal to adjust a height of the individual segments.

38. In a polishing apparatus having a support assembly for supporting a polishing member, wherein a wafer having a diameter is pressed against one side of the polishing member, a platen comprising:

a substantially planar surface positioned underneath the polishing member opposite the wafer, the substantially planar surface positioned in the support assembly and comprising a diameter that is greater than the diameter of the wafer, the platen further comprising a leading edge and a trailing edge, wherein the trailing edge is positioned at an opposite end of the substantially planar surface from the leading edge;

a plurality of fluid channels disposed between the leading and trailing edges of the platen, wherein each of the fluid channels comprises a respective opening defined by the substantially planar surface; and means for providing at least one of a region of altered topography being in the shape of a continuous arc having an arc length less than 180° on a portion of the substantially planar surface of the platen, wherein the arc length of the region of altered topography is relative to a center point of the platen.

39. In a linear polishing apparatus having a linear belt support assembly for supporting a linear belt, wherein a wafer having a diameter is pressed against one side of the linear belt, a platen comprising:

a substantially planar surface positioned underneath the linear belt opposite the wafer, the platen further comprising:

a leading edge and a trailing edge, wherein the trailing edge is positioned at an opposite end of the substantially planar surface from the leading edge; and a leading half and a trailing half, wherein the leading half is separated from the trailing half by a first diameter extending through a center point of the platen, wherein the first diameter is perpendicular to a second diameter extending from the leading edge to the trailing edge;

a plurality of fluid channels disposed between the leading and trailing edges of the platen, wherein each of the fluid channels comprises a respective opening defined by the substantially planar surface; and at least one region of altered topography positioned on a portion of the substantially planar surface, wherein the at least one region of altered topography is located on only one of the leading and trailing halves of the substantially planar surface.

40. The apparatus of claim 39, wherein the at least one region of altered topography is symmetric about the second diameter.

* * * * *

UNITED STATES PATENT AND TRADEMARK OFFICE

CERTIFICATE OF CORRECTION

PATENT NO. : 6,712,679 B2
DATED : March 30, 2004
INVENTOR(S) : Travis R. Taylor et al.

It is certified that error appears in the above-identified patent and that said Letters Patent is hereby corrected as shown below:

Column 10,
Line 50, after "comprises" insert -- a --.

Signed and Sealed this

Third Day of May, 2005

JON W. DUDAS
*Director of the United States Patent and Trademark Office*